US010928148B2

(12) United States Patent
Neitzling

(10) Patent No.: US 10,928,148 B2
(45) Date of Patent: Feb. 23, 2021

(54) BOLT CARRIER SYSTEM

(71) Applicant: NEMO Arms, Inc., Nampa, ID (US)

(72) Inventor: Daniel R. Neitzling, Kalispell, MT (US)

(73) Assignee: NEMO Arms, Inc., Nampa, ID (US)

( * ) Notice: Subject to any disclaimer, the term of this patent is extended or adjusted under 35 U.S.C. 154(b) by 0 days.

(21) Appl. No.: 16/785,084

(22) Filed: Feb. 7, 2020

(65) Prior Publication Data

US 2020/0232730 A1 Jul. 23, 2020

Related U.S. Application Data

(63) Continuation of application No. 16/577,723, filed on Sep. 20, 2019, now Pat. No. 10,563,938, which is a continuation of application No. 15/132,801, filed on Apr. 19, 2016, now Pat. No. 10,458,732, which is a continuation of application No. 14/794,987, filed on Jul. 9, 2015, now Pat. No. 9,322,604, which is a continuation of application No. 13/569,942, filed on Aug. 8, 2012, now Pat. No. 9,103,611.

(51) Int. Cl.

| | |
|---|---|
| ***F41A 3/26*** | (2006.01) |
| ***F41A 5/20*** | (2006.01) |
| ***F41A 3/12*** | (2006.01) |
| ***F41A 3/78*** | (2006.01) |
| ***F41A 5/26*** | (2006.01) |
| *F41A 5/18* | (2006.01) |

(52) U.S. Cl.

CPC *F41A 3/26* (2013.01); *F41A 3/12* (2013.01); *F41A 3/78* (2013.01); *F41A 5/20* (2013.01); *F41A 5/26* (2013.01); *F41A 5/18* (2013.01)

(58) Field of Classification Search

CPC ..... F41A 3/78; F41A 3/12; F41A 3/94; F41A 5/28; F41A 3/26; F41A 3/20; F41A 3/18; F41C 23/04; F41C 23/06

See application file for complete search history.

(56) References Cited

U.S. PATENT DOCUMENTS

| | | | |
|---|---|---|---|
| 1,441,807 | A | 1/1923 | Horan |
| 2,375,721 | A | 5/1945 | Woodhull |
| 2,391,864 | A | 1/1946 | Chandler |
| 2,900,877 | A | 1/1959 | McCienaham |
| 3,507,187 | A | 4/1970 | Maillard |
| 3,566,744 | A | 3/1971 | Stoner |

(Continued)

*Primary Examiner* — Benjamin P Lee

(74) *Attorney, Agent, or Firm* — Heslin Rothenberg Farley & Mesiti P.C.

(57) ABSTRACT

A semi-automatic or automatic rifle comprising a barrel attached to and upper receiver and including a compressible bolt carrier extension system. The compressible bolt carrier extension system includes a bolt carrier, an extension spring, two pins, and a reciprocation bolt carrier extension piece. As a whole, the compressible bolt carrier extension system makes possible the use of elongated upper and lower receivers to be used for chambering long-action or other center fire cartridges for use with AR rifles such as the M-16, and M4 etc., eliminating the need for any buffer or buffer tubes other than those commercially available. A further advantage of the compressible bolt carrier extension system is the reduction of felt recoil as the system fully loads during the recoil stroke as it pushes against the buffer absorbing additional recoil energy. The system can be incorporated into firearms using a variety of cartridges.

20 Claims, 12 Drawing Sheets

(56) References Cited

U.S. PATENT DOCUMENTS

| | | | |
|---|---|---|---|
| 3,742,638 | A | 7/1973 | Archer |
| 3,748,959 | A | 7/1973 | Moller et al. |
| 3,776,095 | A | 12/1973 | Atchisson |
| 3,969,983 | A | 7/1976 | Zellweger et al. |
| 4,028,993 | A | 6/1977 | Reynolds |
| 4,240,324 | A | 12/1980 | Smith et al. |
| 4,398,448 | A | 8/1983 | Lafever |
| 4,604,942 | A | 8/1986 | Benelli |
| 5,069,110 | A | 12/1991 | Menck |
| 5,827,992 | A | 10/1998 | Harris et al. |
| 5,909,002 | A | 6/1999 | Atchisson |
| 5,911,173 | A | 6/1999 | Westrom |
| 6,044,748 | A | 4/2000 | Westrom |
| 6,182,389 | B1 | 2/2001 | Lewis |
| 6,536,150 | B2 | 3/2003 | Schweikart |
| 6,564,491 | B2 | 5/2003 | Murello |
| 6,625,917 | B2 | 9/2003 | Murello et al. |
| 6,684,547 | B2 | 2/2004 | Poff, Jr. |
| 6,829,974 | B1 | 12/2004 | Gwinn, Jr. |
| 7,131,367 | B1 | 11/2006 | Boerschig et al. |
| 7,444,775 | B1 | 11/2008 | Schuetz |
| 7,849,777 | B1 | 12/2010 | Zedrosser |
| 7,886,470 | B1 | 2/2011 | Doiron |
| 7,963,203 | B1 | 6/2011 | Davies |
| 8,297,175 | B1 | 10/2012 | Davies |
| 8,430,015 | B2 | 4/2013 | Faifer |
| 9,103,611 | B2 | 8/2015 | Neitzling |
| 9,322,604 | B2 | 4/2016 | Neitzling |
| 2006/0236853 | A1 | 10/2006 | Boerschig et al. |
| 2012/0180648 | A1 | 7/2012 | Sullivan et al. |

BOLT CARRIER SYSTEM

CROSS REFERENCE TO RELATED APPLICATIONS

This application is a continuation of application Ser. No. 16/577,723, filed on Sep. 20, 2019, which is a continuation of application Ser. No. 15/132,801, filed on Apr. 19, 2016, which is a continuation of application Ser. No. 14/794,987, filed on Jul. 9, 2015, which is a continuation of application Ser. No. 13/569,942, filed on Aug. 8, 2012, the entirety of which are hereby incorporated herein by reference.

FIELD OF INVENTION

The present invention relates to firearms.

More particularly, the present invention relates to automatic, semi-automatic and similar types of weapons and more specifically to modifications of the bolt carrier group of M14, M16, and M4 type rifles for use current and different cartridges not originally designed for the M16, M4, and AR-15 type platform.

BACKGROUND OF THE INVENTION

Since the Vietnam War, the M16 rifle family has been the primary rifle of the U.S. armed forces. The M16 is a family designation for several adaptations of this rifle to include the AR10®, AR-15, M16A1, M16A2, M4A1, M16A1 and the like and therefore being understood that the discussion herein includes this family of M16 style rifles but is not limited to it.

The family of M16 style rifles has undergone several modifications since it was first developed by Eugene Stoner and ArmaLite in 1954. Modifications include barrel length, barrel profile, rifling twist, barrel materials, hand-guard shapes, butt-stock types, grip types, lower receiver types, upper receiver types, rear sight types, rail systems, front sight types, muzzle devices, forward assist means, case deflectors, bayonet lug, trigger packs, and gas and piston operating systems. There have also been significant modifications to materials to reduce weight and improve component strength such as the use of polymers in butt-stocks, grips, and hand-guards. Modifications have basically improved the reliability and functionality of the M16 family of rifles without drastically changing the basic look and design of the original Stoner rifle. In the late 1950's the NATO 7.62×51 mm cartridge was introduced in U.S. service in the M14 rifle and M60 machine gun. The M14 was later superseded in the U.S. service as the infantry adopted the 5.56×45 mm NATO M16. Although the 7.62×51 NATO round was superseded by the later 5.56×51 NATO round, it is still in use in the M14 and other firearms as sniper rifles, machine guns and weapon of choice by special operation forces. M16 style rifles using the NATO 5.56×45 mm cartridge, or the M 193 cartridge designed by Winchester, later the Belgian 5.56 mm SS 109 cartridge was adopted as the standard by NATO due to its improved penetration design. Later, Colt developed the AR-15 models 601 and 602 which utilized the .223 caliber round. These two caliber rounds are still the primary rounds used in the M16 family of rifles by the military today with some variations in ammunition types.

One of the major problems with the M14 & M16 rifles is that they are limited in the size of caliber that can be used with a standard size bolt carrier and standard size butt assembly system. In order to increase the size of caliber beyond the NATO 5.56×45 round, the .223 caliber round, and the 7.62×51 mm NATO round, changes to the length of the bolt carrier, and size of the magazine well must also be proportionally increased to allow the bolt carrier assembly to eject a spent cartridge on the back stroke and insert a new cartridge from the magazine well into battery position on the return stroke. Lengthening of the bolt carrier would then necessitate that the butt assembly would also have to be extended to receive the longer bolt carrier when a round is fired. This creates two problems, first, it would require that a proprietary longer butt stock assembly be manufactured, and second, a larger butt stock assembly adds additional weight to the rifle. Both of these are unacceptable modifications for the military. U.S. Pat. No. 7,963,203 B1 makes use of a modified bolt carrier utilizing a weight element for timing purposes. U.S. Pat. No. 4,398,448 makes use of a buffered bolt assembly to reduce the load on the latch and cam pins during the firing cycle. Neither patent addresses modifications to the bolt carrier which extend the length of thereof to accommodate the use of other center fire cartridges within a standard butt assembly as claimed by the current invention.

It would be very advantages therefore, to remedy the foregoing deficiencies in the prior art to allow the use of larger caliber or long-action cartridges to be used with a standard OEM buffer assembly on an AR, M16, or M4 type platform, in particular for use as a sniper rifle for special operation forces, law enforcement, and for civilian use as a hunting rifle.

Accordingly, the present invention provides for a compressible bolt carrier extension that in a fully compressed state allows for a lengthened bolt carrier to function using long-action or other center fire cartridges within a standard OEM buffer assembly currently used with the M16 and M4 family of rifles.

A further object of the invention is to lessen felt recoil in the M16, AR, or M4 type rifle.

SUMMARY OF INVENTION

In brief, to achieve the desired objects of the present invention in accordance with the preferred embodiment thereof, provided is a compressible bolt carrier extension system for use on the AR, M16, and M4 family of rifles. In the preferred embodiment the invention may use one or all of a modified operating system, a modified bolt carrier, modified buffer, and a compressible bolt carrier extension. Said modifications facilitate the use of long-action or other center fire cartridges to be fired utilizing a standard OEM buffer system. Another benefit of the compressible bolt carrier extension acting in unison with the buffer spring is to reduce felt recoil.

According to the preferred embodiment an AR style bolt carrier is modified on the aft end for receiving a compressible bolt carrier extension. The aft end of an AR style bolt carrier is hereby modified by creating a bolt carrier branch notch having two parallel bolt carrier branches with holes in axial alignment for receiving a pin to attach a compressible bolt carrier extension thereto.

In a more specific embodiment of the invention, the modified compressible bolt carrier extension system includes a carrier extension piece having a cylindrical cavity for receiving an extension spring held in place by forward and aft pins. The forward pin attaches the forward extension spring looped end to the forward end of the carrier extension piece. The aft pin attaches the aft end of the extension spring looped end to the aft end of the bolt carrier. As the aft pin passes through a first carrier branch it then passes through a first axially aligned carrier extension length limiting slot and then through a second axially aligned carrier extension length limiting slot and into a second carrier branch. The carrier extension piece is now affixed to the aft end of the bolt carrier in a pre-loaded and operative state received within the aft end of the bolt carrier cylindrical cavity. In its pre-loaded and operative state, the compressible bolt carrier extension piece desired length, for utilizing long-action cartridges, is fixed by the axially aligned carrier extension limiting slots as it comes in contact with the bolt carrier aft pin.

The modified buffer system herein described pertains primarily to the elongated compression spring positioned in a tubular extension of a standard OEM butt stock member attached to a lower receiver being in axial alignment with the upper receiver so as to be in abutting engagement with the compressible bolt carrier extension and the modified bolt carrier of an AR or M16, or M4 type rifles. As described prior, the compressible bolt carrier extension is in a pre-loaded state. Both buffer spring and compressible bolt carrier spring are designed to load after firing a cartridge as some of the propellant gases are bled off during the firing cycle and forced back through a gas tube or gas impingement system where such gases are sufficient to act upon the bolt carrier forcing it to an open position in order to extract a spent cartridge. A gas piston system can also be used for this purpose. In a gas piston system gases are bled off during the firing cycle acting upon a piston which in turn pushes a rod attached to the bolt carrier forcing it to an open position to extract a spent cartridge. As a round is fired using either of the systems describe herein, the modified bolt carrier and the compressible bolt carrier extension spring begins to load against the buffer spring as the bolt and bolt carrier system move from a locked position to an open position. In a fully retracted position the compressible bolt carrier extension is in a fully loaded state against the fully retracted buffer spring within a standard OEM butt stock assembly. As the bolt and bolt carrier system move from an open towards a closed position the buffer spring starts to unload against the compressible bolt carrier extension, which is also moving from a fully loaded state towards an unloaded state both of which acting together create a sufficient force to strip a new cartridge form the magazine and lock it into battery position.

The timing of the firing cycle is critical to single, burst, and automatic fire in AR, M16, or M4 type rifles and therefore may require that the buffer spring and compressible bolt carrier extension spring be adjusted accordingly or accurately matched to prevent jamming or other harmful problems from occurring during the firing cycle. A second and equally important benefit of the preferred embodiment is reduction of felt recoil. The compressible bolt carrier extension having a spring which loads during the firing cycle, and acting in unison with the buffer spring absorbs more recoil energy than a buffer spring acting alone and therein lessons wear and tear on parts, and ultimately upon the operator.

DETAILED DESCRIPTION OF A PREFERRED EMBODIMENT

Figure 1:
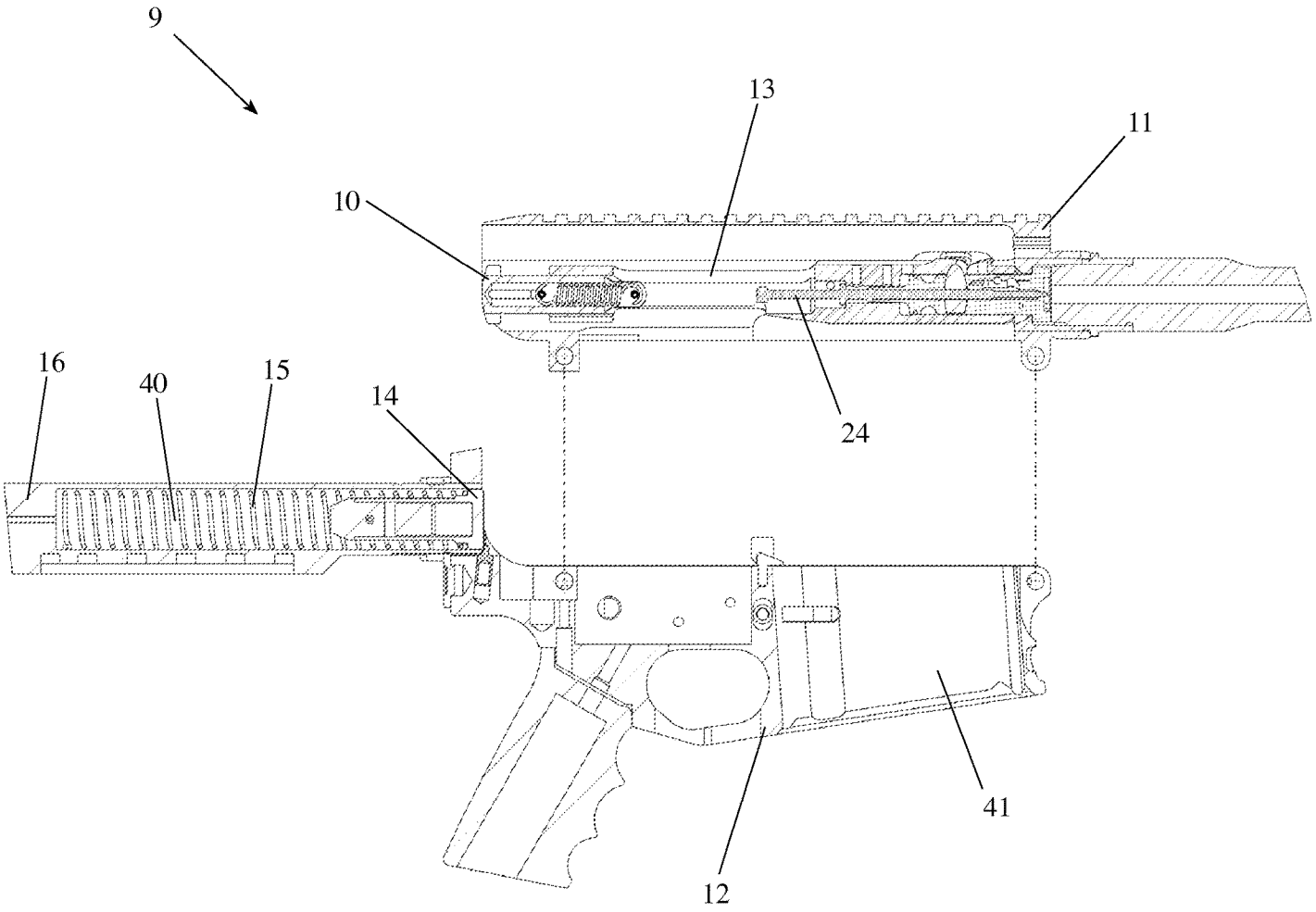
FIG. 1 is a cross section view of an M16 family style rifle with the compressible bolt carrier extension system installed.
Figure 5:
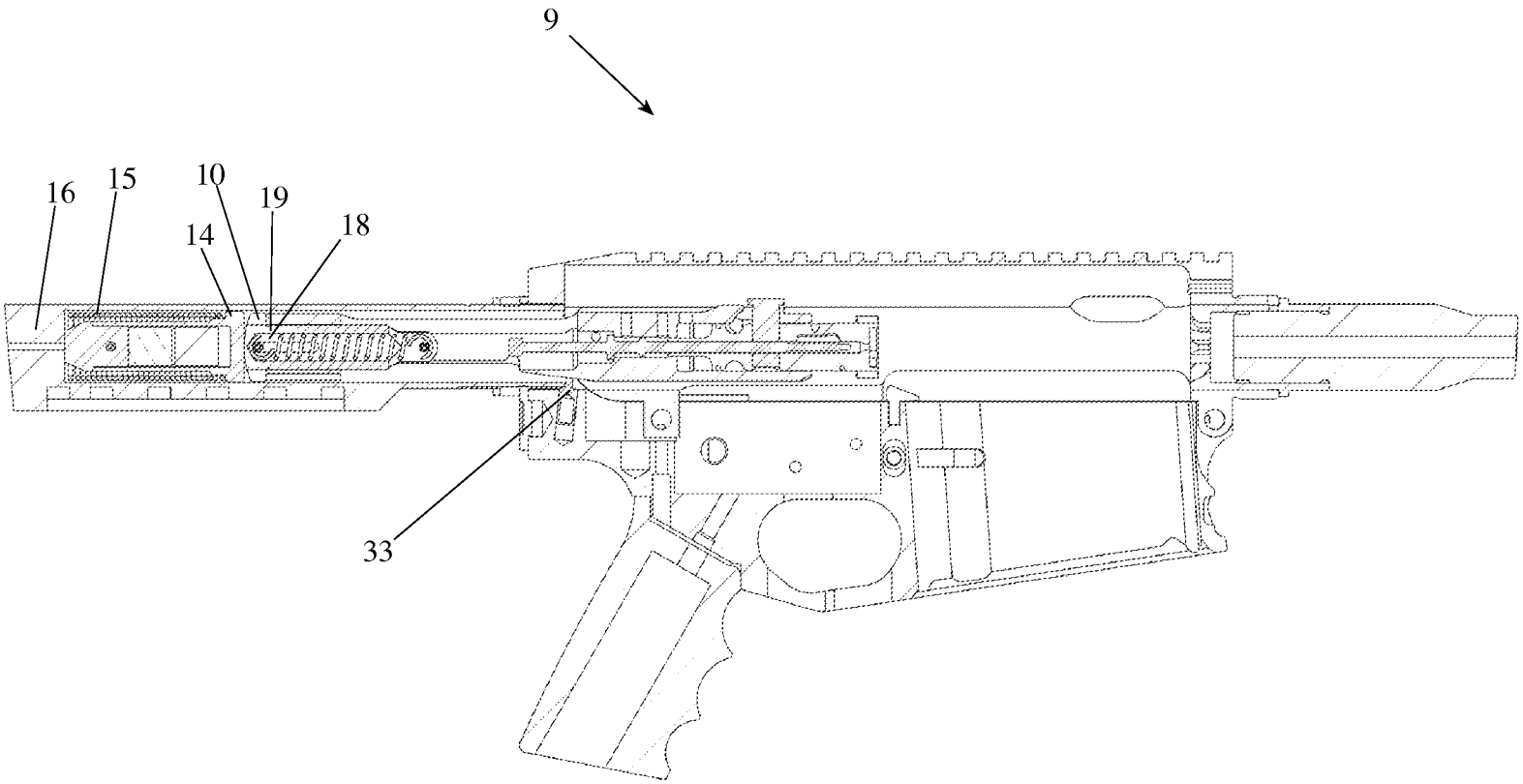
FIG. 5 is a cutaway view of the rifle showing the preferred embodiment in its fully loaded state of FIG. 4

Turning now to the drawings, reference characters throughout the several drawings depict like elements. FIG. 1 illustrates a side view of a rifle generally designated 9. In which is illustrated the preferred embodiment 10 of the invention installed in an upper receiver 11 of the family of M16/AR style rifles 9 in a pre-loaded state. It should be understood by one skilled in the art that any of the family of M16 style rifles may incorporate one or more of the modifications described herein. It should also be understood that all the family of M16 rifles having the designation M proceeding the model number as well as the designation AR are included but not limited thereto. Now turning back to FIG. 1, the upper receiver 11 and lower receiver 12 are configured in the current invention to accommodate the chambering of other center fire or long-action cartridges for use in AR style rifles 9. To accomplish using a long action cartridge on an AR type rifle 9, the upper receiver 11, lower receiver 12, and magazine well 41, all may have to be enlarged proportionally so as to accommodate a longer bolt carrier 13. In order to proportionally enlarge elements 11, 12, and 13, for use with long-action cartridges, the weighted buffer assembly 14, buffer spring 15, buffer tube cylindrical cavity 40 and buffer tube 16 would also have to be modified proportionally to receive the longer bolt carrier 13, in a retracted position as shown in FIG. 5. This would require the use of proprietary and non-commercially available buffer tube 16, buffer spring 15, and weighted buffer assembly 14 to be developed creating additional costs in tooling, manufacturing, sales, and marketing all of which the preferred embodiment of current invention solves.

Turning now to FIGS. 2-9 with further reference to FIG. 1 the preferred embodiment 10 of the current invention will be fully described. FIG. 2A shows an exploded view of the preferred embodiment 10 of the invention specifically. The compressible bolt carrier extension system 10 consists of bolt carrier extension piece 19, having end flange 44, extension spring 17 having fore and aft spring looped ends 20, a fore pin 21 connecting the fore looped end 20 of extension spring 17 to two horizontal bolt carrier extension piece apertures 22 located in the forward end of bolt carrier extension piece branches 23. The aft pin 25 connects the aft looped end 20 of the extension spring 17 to the aft end of the bolt carrier 13 through bolt carrier branches 27 and bolt carrier extension piece length limiting and alignment slots 28. The exterior carrier extension piece cylindrical surface 38 slide ably fits within the bolt carrier cylindrical cavity 39. FIG. 2A is shown an elongated bolt carrier firing pin access slot 43 to allow removal of the firing pin 24 without disassembly of the compressible bolt carrier extension system 10. FIG. 2B shows the fore pin 21 installed through horizontal bolt carrier extension piece apertures 22 and forward looped end 20 of the extension spring 17. FIG. 2B also depicts the installation of aft pin 25 through horizontal bolt carrier apertures 26, bolt carrier extension piece length limiting and alignment slots 28, and aft looped extension spring end 20 of extension spring 17.

Figure 3:
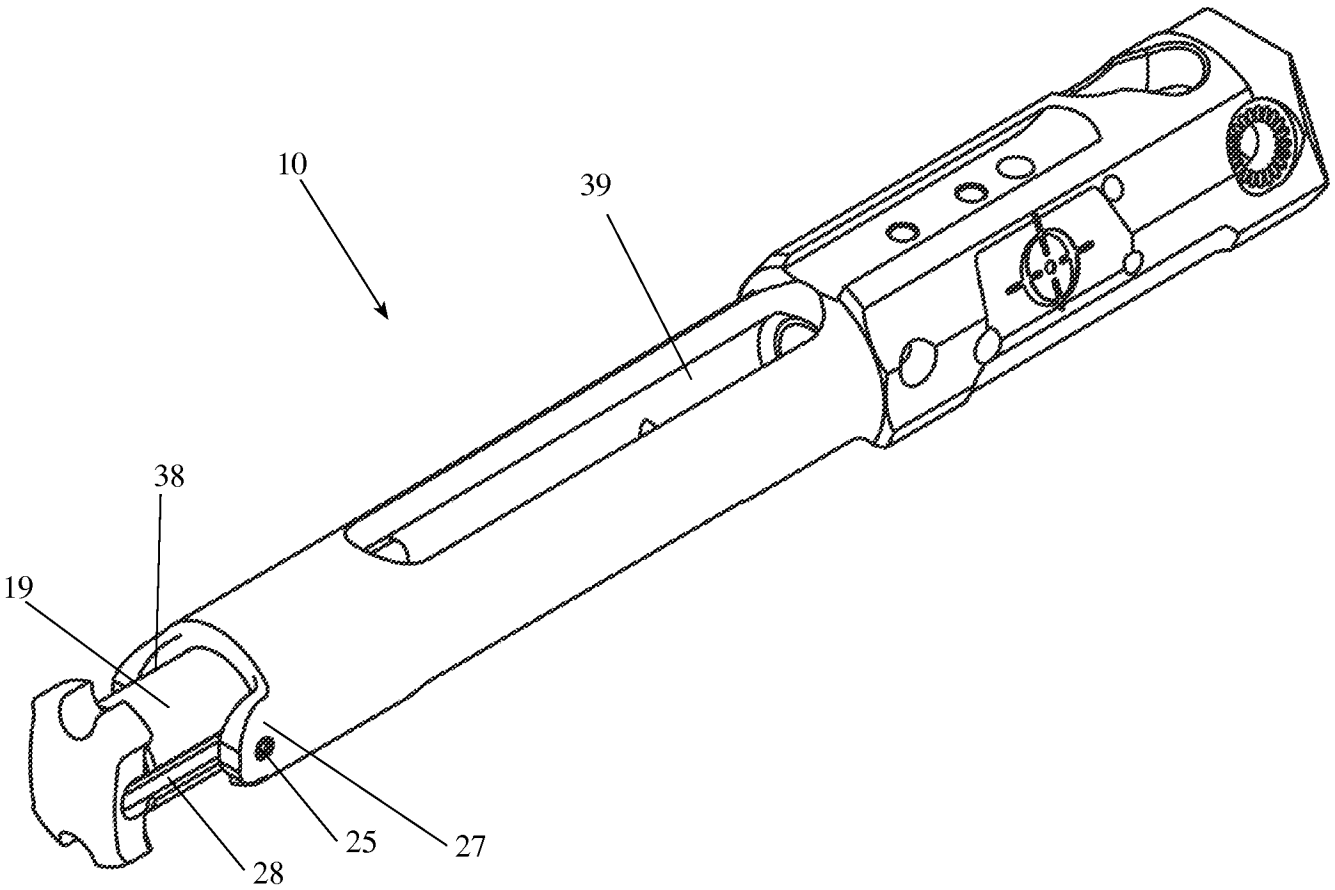
FIG. 3 is a perspective view of the current invention in its initially loaded state

Referring now to FIG. 3 is shown a fully assembled compressible bolt carrier extension system 10 with the exterior bolt carrier extension piece cylindrical surface 38 inserted into the aft end of the bolt carrier cylindrical cavity 39 in its initially loaded state and being held in its correct alignment by aft pin 25 as it passes through bolt carrier branches 27 and bolt carrier extension piece length limiting and alignment slots 28. The bolt carrier extension piece length limiting and alignment slots 28 are of a predetermined length coming to a stop against the aft pin 25 which determines the overall desired length of the compressible bolt carrier extension system 10 in its initially loaded state.

Figure 4:
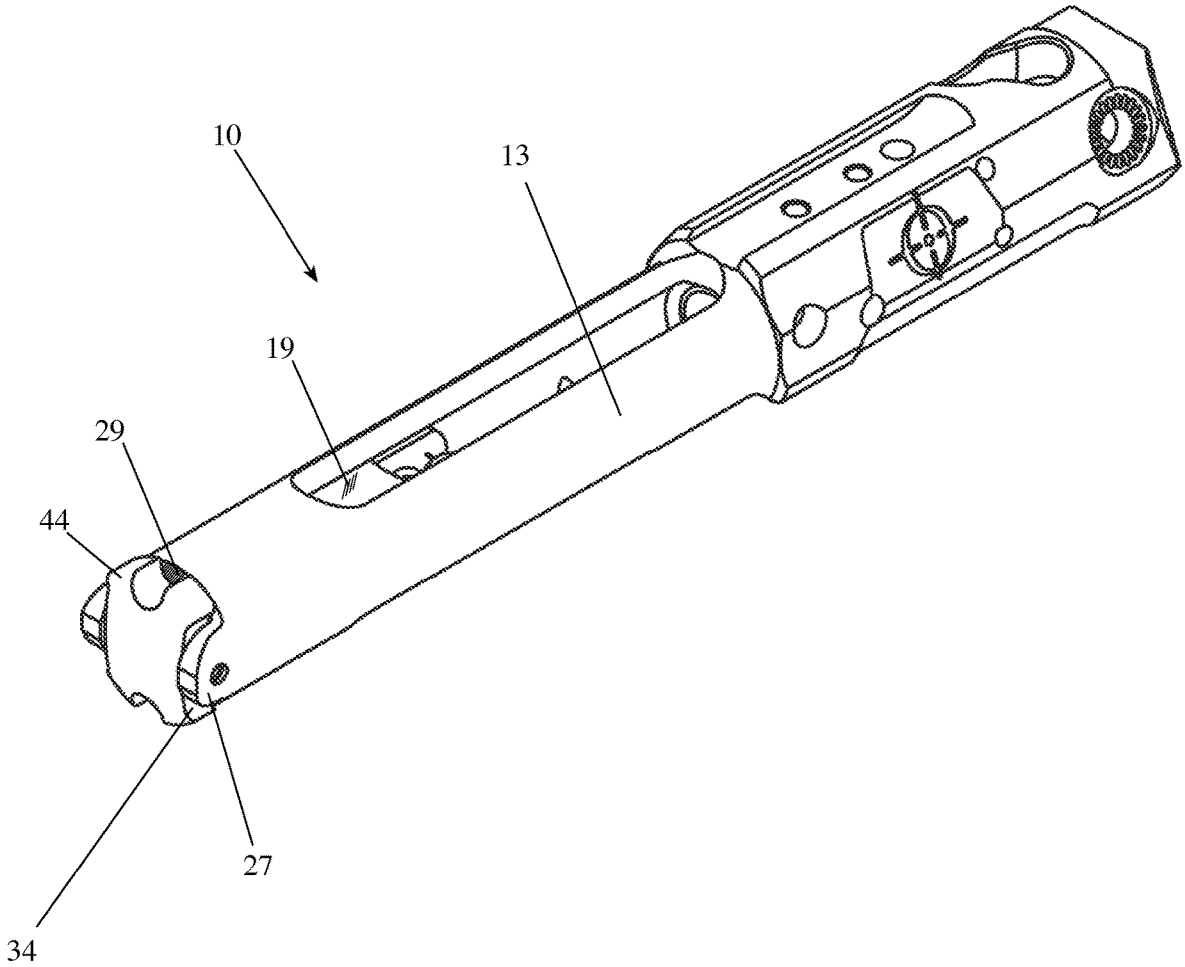
FIG. 4 is a perspective view of the current invention in its fully loaded state of FIG. 3.

Turning now to FIG. 4, is shown the compressible bolt carrier extension system 10 with compressible bolt carrier extension piece 19 in a fully loaded state wherein the bolt carrier extension piece 19 and end flange 44 is fully docked and in contact with the aft bolt carrier face 29. This position would be achieved during the firing cycle when the bolt carrier extension system 10 is in a fully retracted position within the buffer tube 16 as referenced in FIG. 1. It is also shown that the compressible bolt carrier extension piece clearance notches 34 allow docking of the compressible bolt carrier extension 19 within the bolt carrier 13 by clearing bolt carrier branches 27.

Figures 2A, 2B:
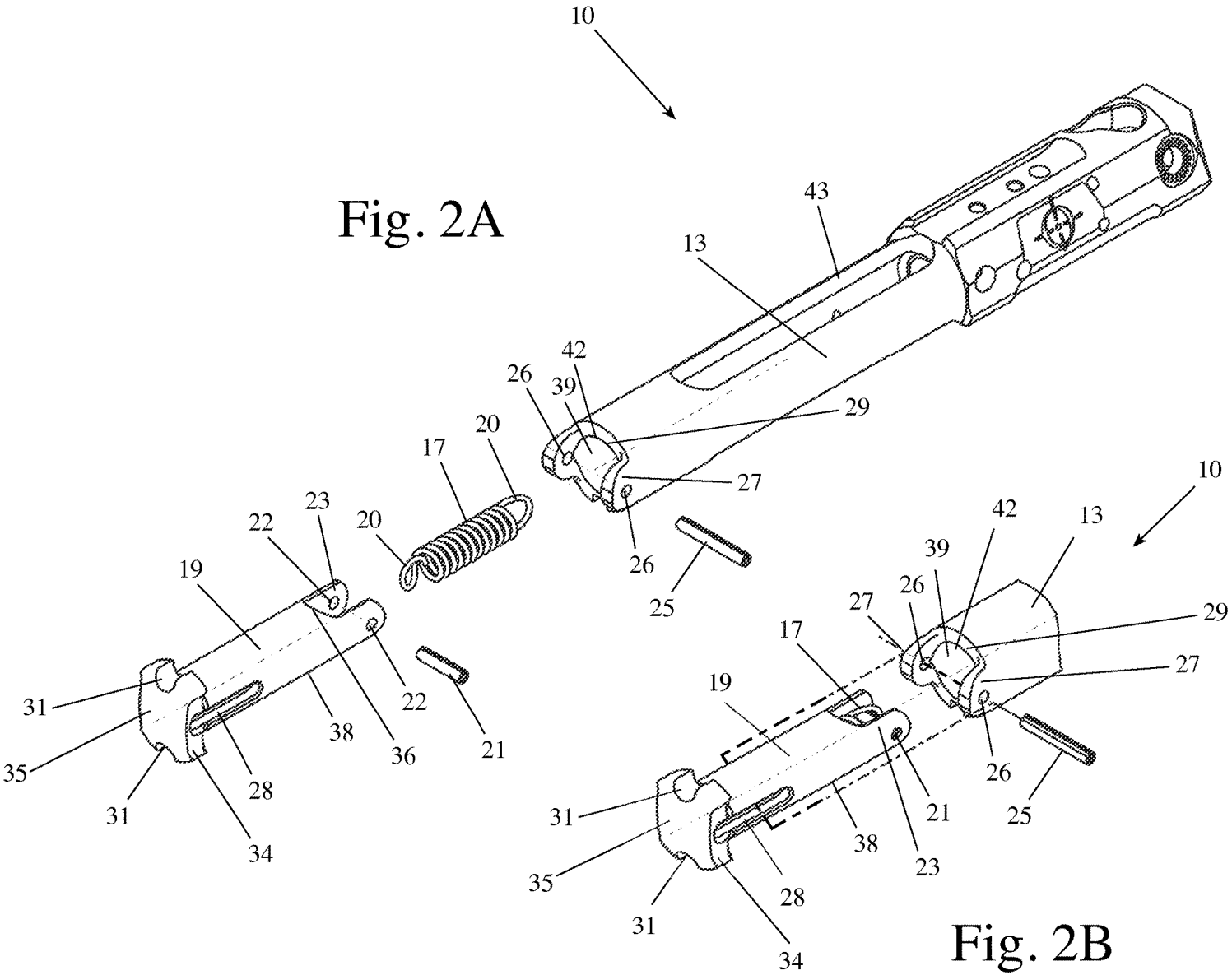
FIGS. 2A and 2B are perspective exploded views the preferred embodiment of the compressible bolt carrier extension system.

Referring now to FIG. 5 is shown the present invention with compressible bolt carrier extension piece 19 as part of the complete compressible bolt carrier extension system 10 in its fully loaded and compressed state within a commercially available buffer tube 16. During the firing cycle the compressible bolt carrier extension system 10 moves in a rearward direction causing both the buffer spring 15 and compressible bolt carrier extension piece 19 to compress fully within the buffer tube 16. During this compression cycle of buffer spring 15 and compressible bolt carrier extension piece 19 pushing against one another, additional energy is absorbed during the firing cycle reducing the effect of felt recoil on a shooter. It is to be understood that adjustments to the compressible bolt carrier extension system 10 as shown in FIGS. 2A and 2B can be made for the use of specific cartridges.

Figure 6:
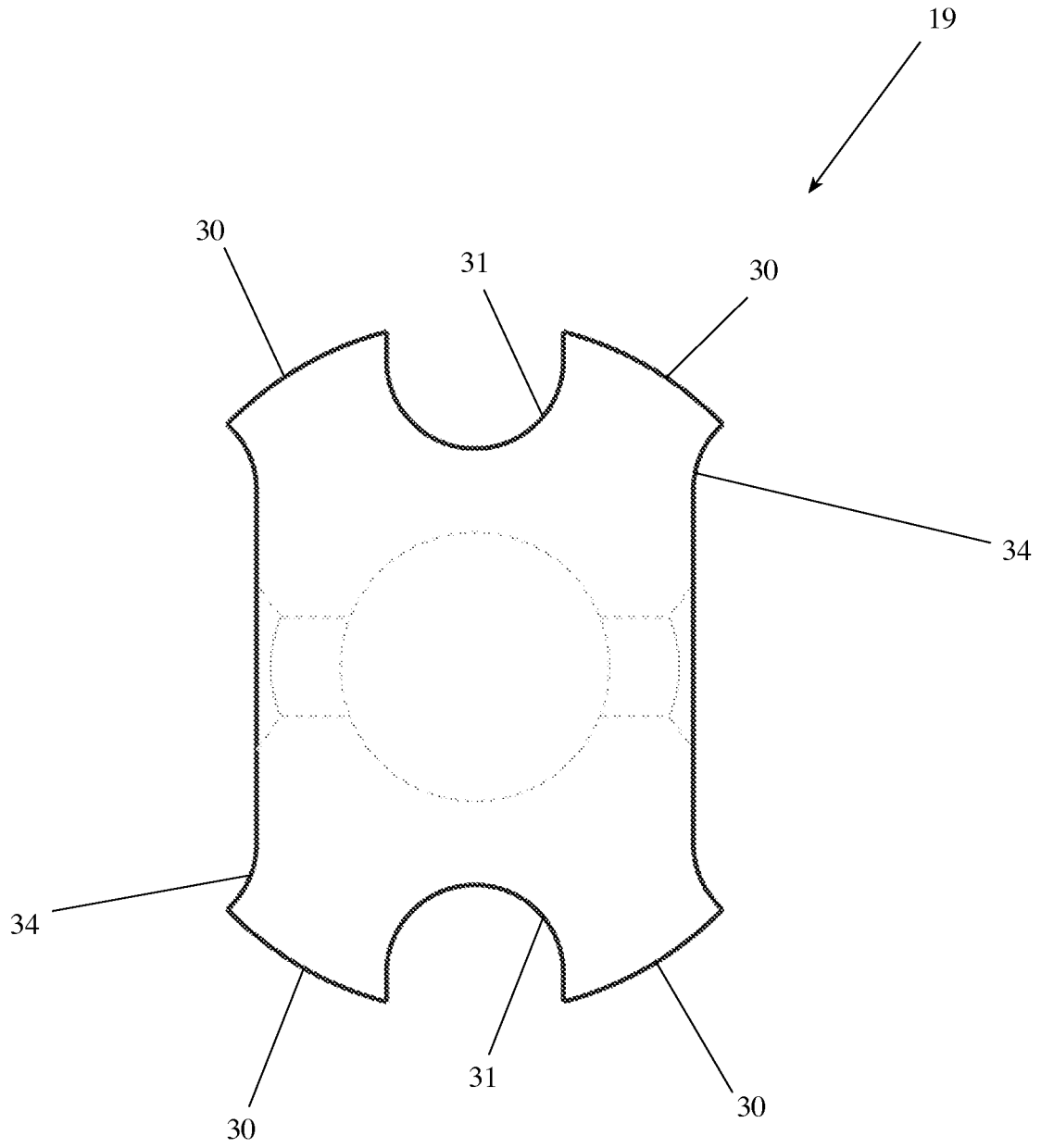
FIG. 6 is a rear view of the bolt carrier extension piece.
Figure 7:
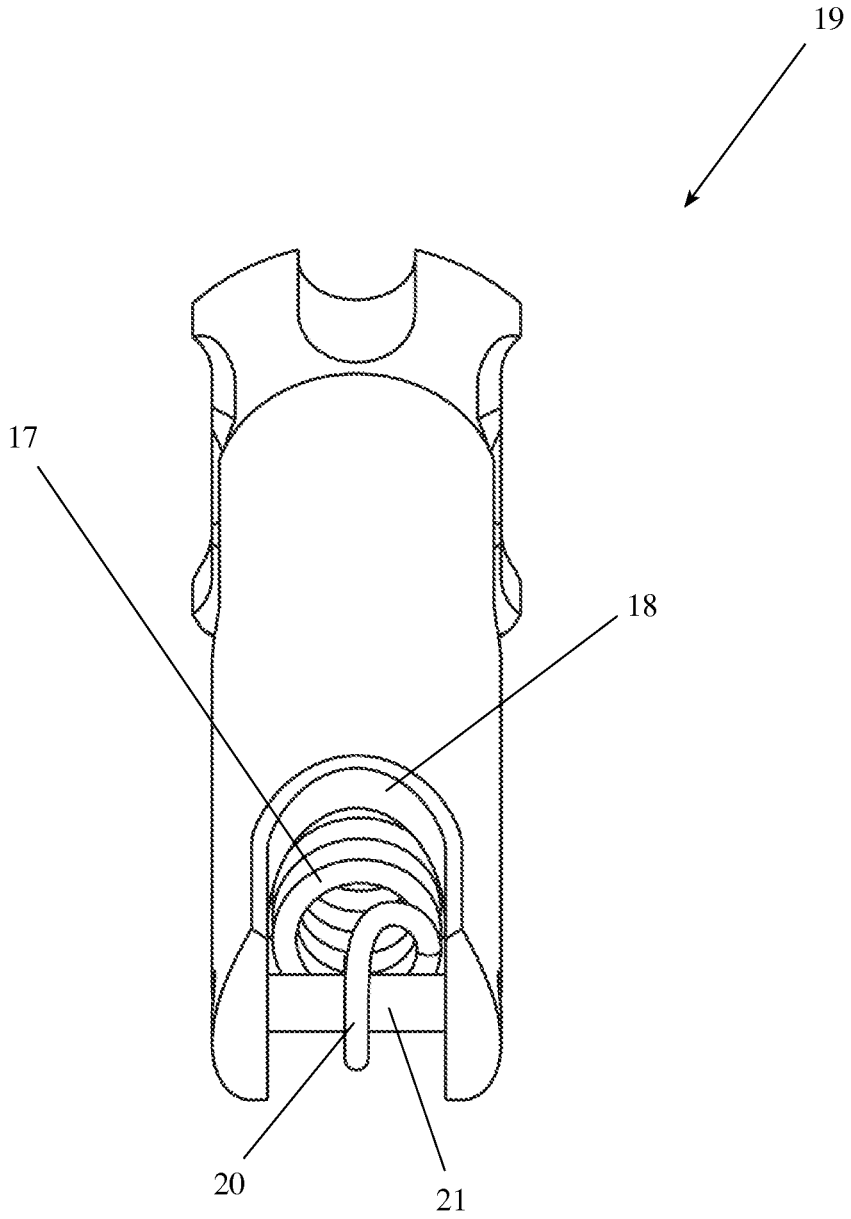
FIG. 7 is a front perspective view of the carrier extension piece of FIG. 6.

Turning now to FIGS. 6-7 with further references to FIG. 4-5 are shown specific elements of the compressible bolt carrier extension piece 19 in several views. FIG. 6 shows an aft end view of the compressible bolt carrier extension piece 19. Bolt carrier extension piece radius tabs 30 are dimensioned to fit inside buffer tube cylindrical cavity 40 of buffer tube 16 as shown in FIG. 5. Bolt carrier extension piece buffer retaining pin clearance grooves 31 located on the top and bottom of compressible bolt carrier extension piece 19 provide clearance for the compressible bolt carrier extension piece 19 to clear the buffer retaining pin 33 shown in FIG. 5 as the compressible bolt carrier extension system 10 moves to a retracted position and then to a closed position during the firing cycle. Bolt carrier extension piece clearance notches 34 provide clearance for docking in the aft end of the bolt carrier extension piece 19 within bolt carrier branches 27 to the aft end of bolt carrier 13. FIG. 7 shows forward pin 21 installed through fore looped end 20 of extension spring 17 in bolt carrier extension piece 19. Extension spring 17 is installed in bolt carrier extension piece cylindrical cavity 18, also shown in FIG. 5.

Figure 8:
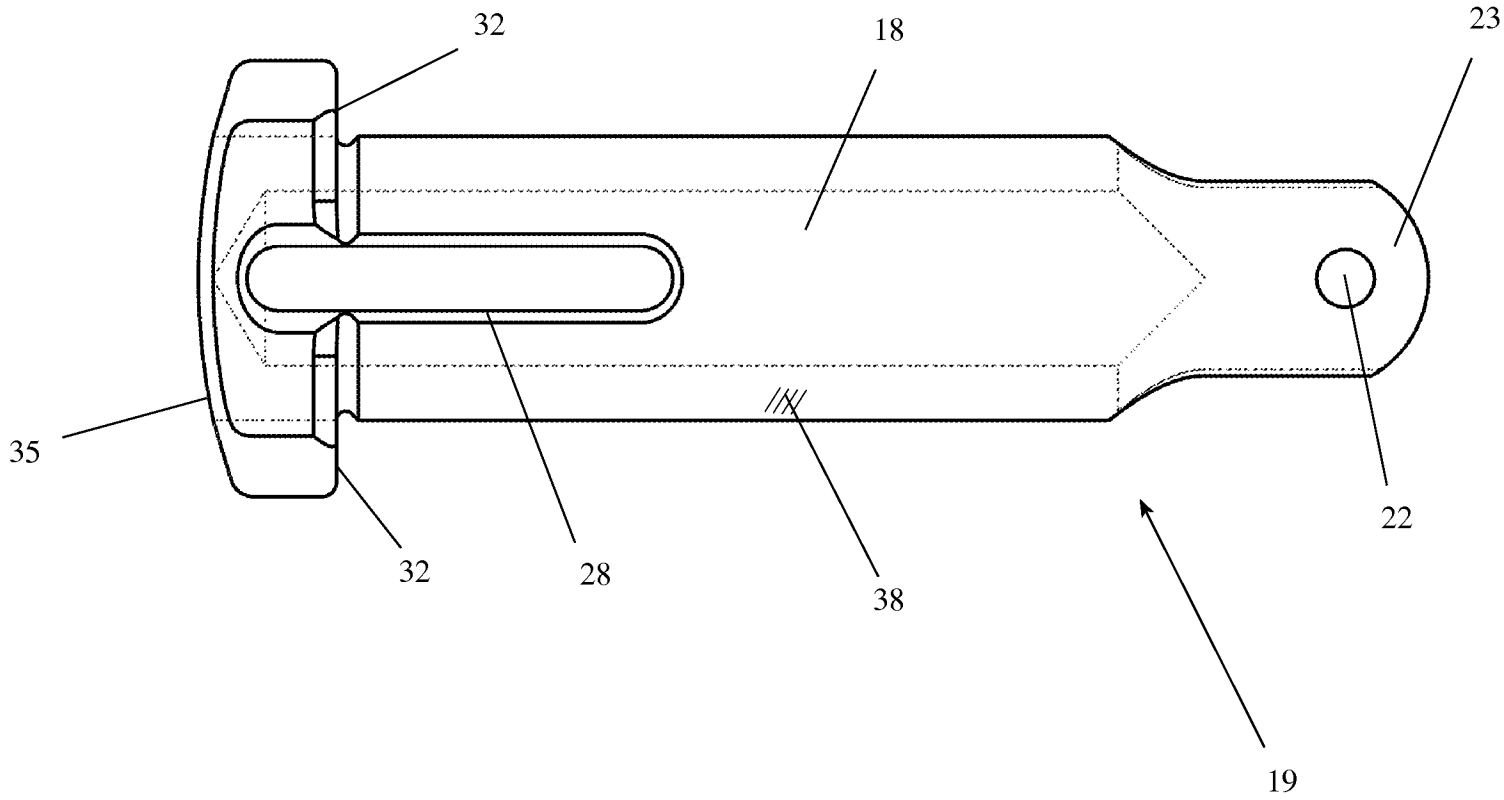
FIG. 8 is a side view of the carrier extension piece of FIG. 7.
Figure 9:
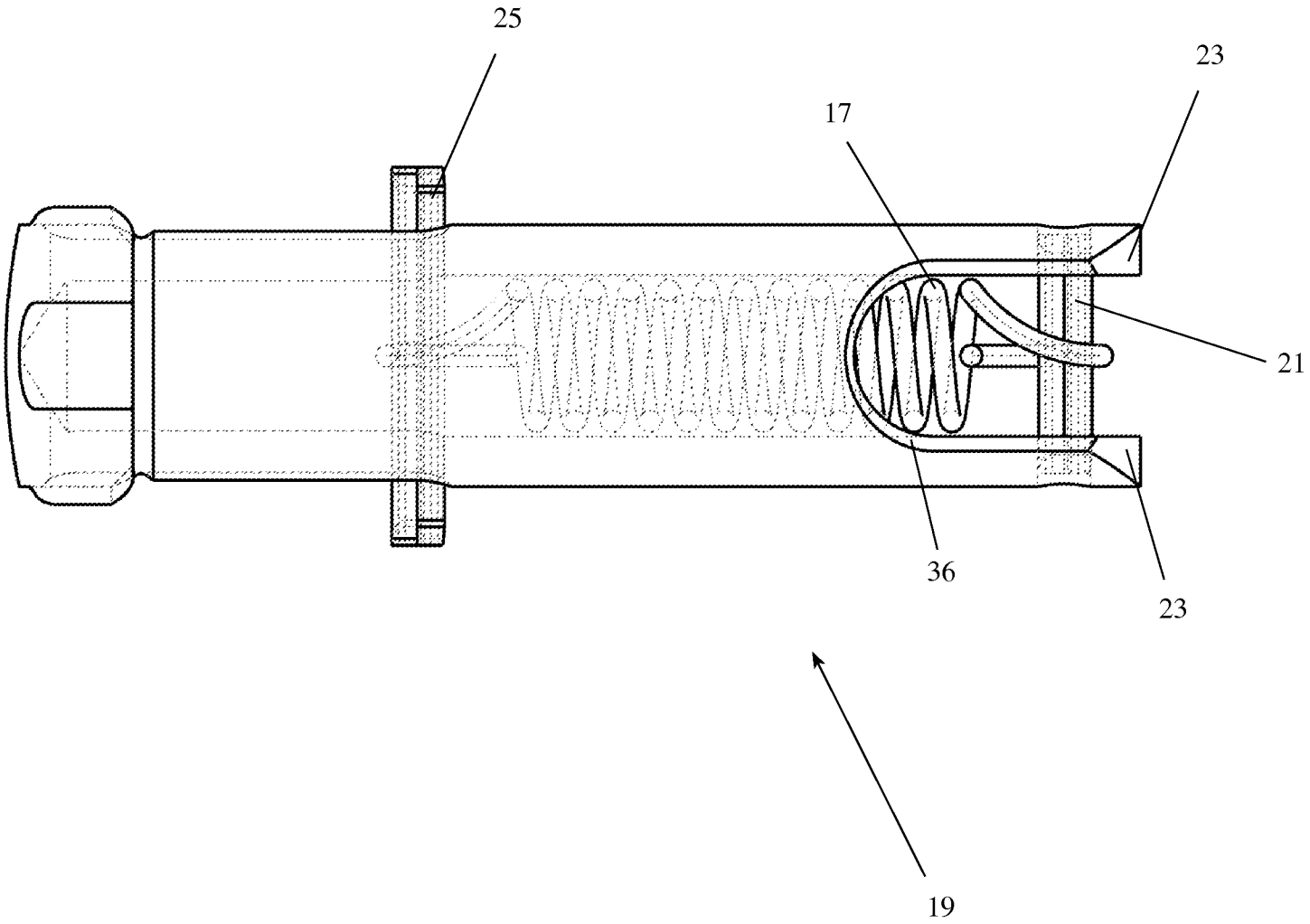
FIG. 9 is a top view of the carrier extension piece of FIG. 8.

FIGS. 8-9 show side views of the compressible bolt carrier extension piece 19 with a clearly defined spherical radius surface 35 on the aft end of the compressible bolt carrier extension piece 19 providing for a low friction single tangency point of contact with the weighted buffer assembly 14 as also shown in FIG. 5 Also shown are compressible bolt carrier extension piece length limiting and alignment slots 28, compressible bolt carrier extension piece forward stop surface 32, bolt carrier extension piece cylindrical cavity 18, bolt carrier extension piece exterior cylindrical surface 38, horizontal bolt carrier extension piece apertures 22, and compressible bolt carrier extension branches 23. FIG. 9 is shown a top view of the compressible bolt carrier extension piece 19, compressible bolt carrier extension branches 23, and extension spring access cut out 36 allowing access for assembly of extension spring 17. FIG. 9 further shows the pre-loaded state of the preferred embodiment 19 with fore pin 21 and aft pin 25 installed loading extension spring 17.

Figure 10:
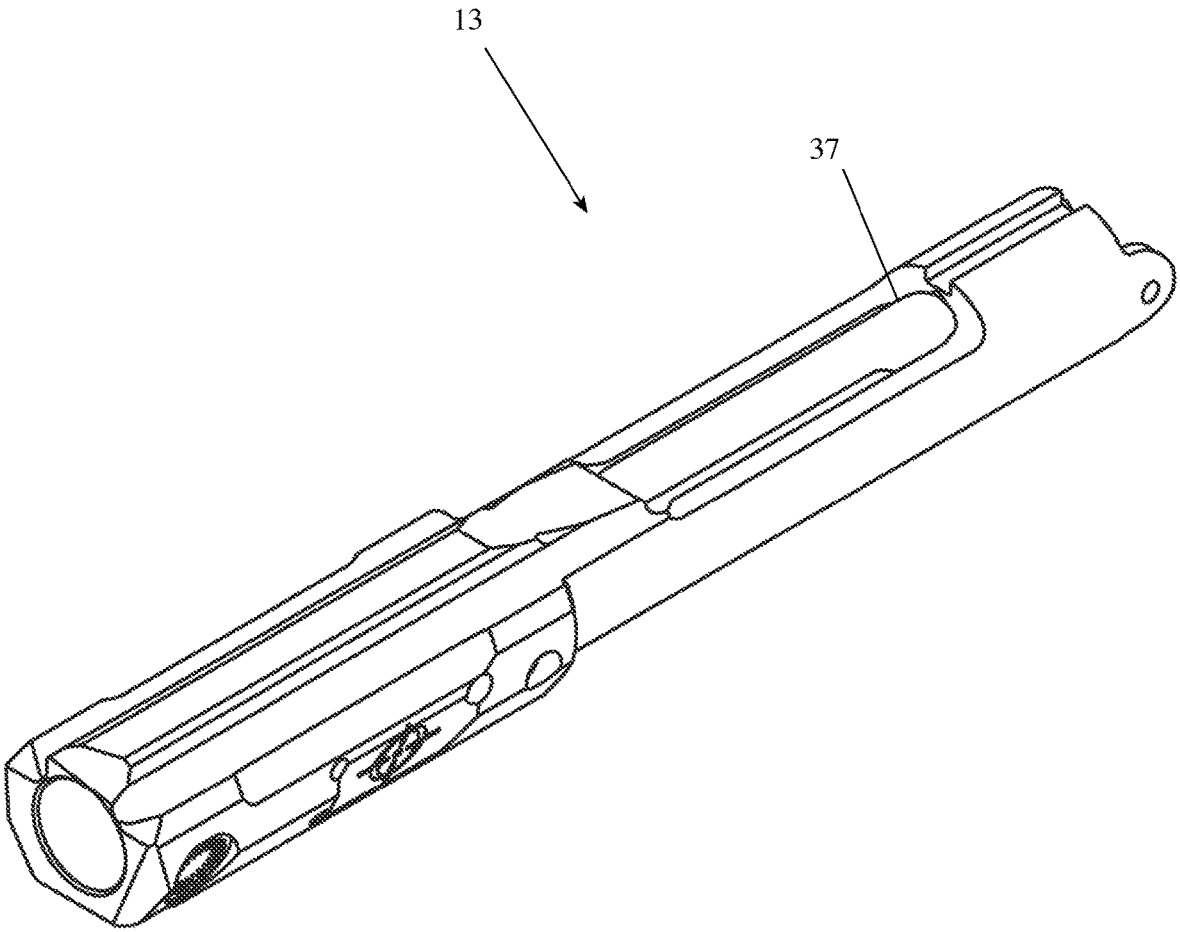
FIG. 10 is a bottom perspective view of the bolt carrier.

FIG. 10 is shown the bolt carrier 13 and bolt carrier hammer slot 37 which allows clearance for the firing pin 24, as shown in FIG. 1, to be struck by the hammer and interfaces with an auto sear for fully automatic firing.

Figure 11:
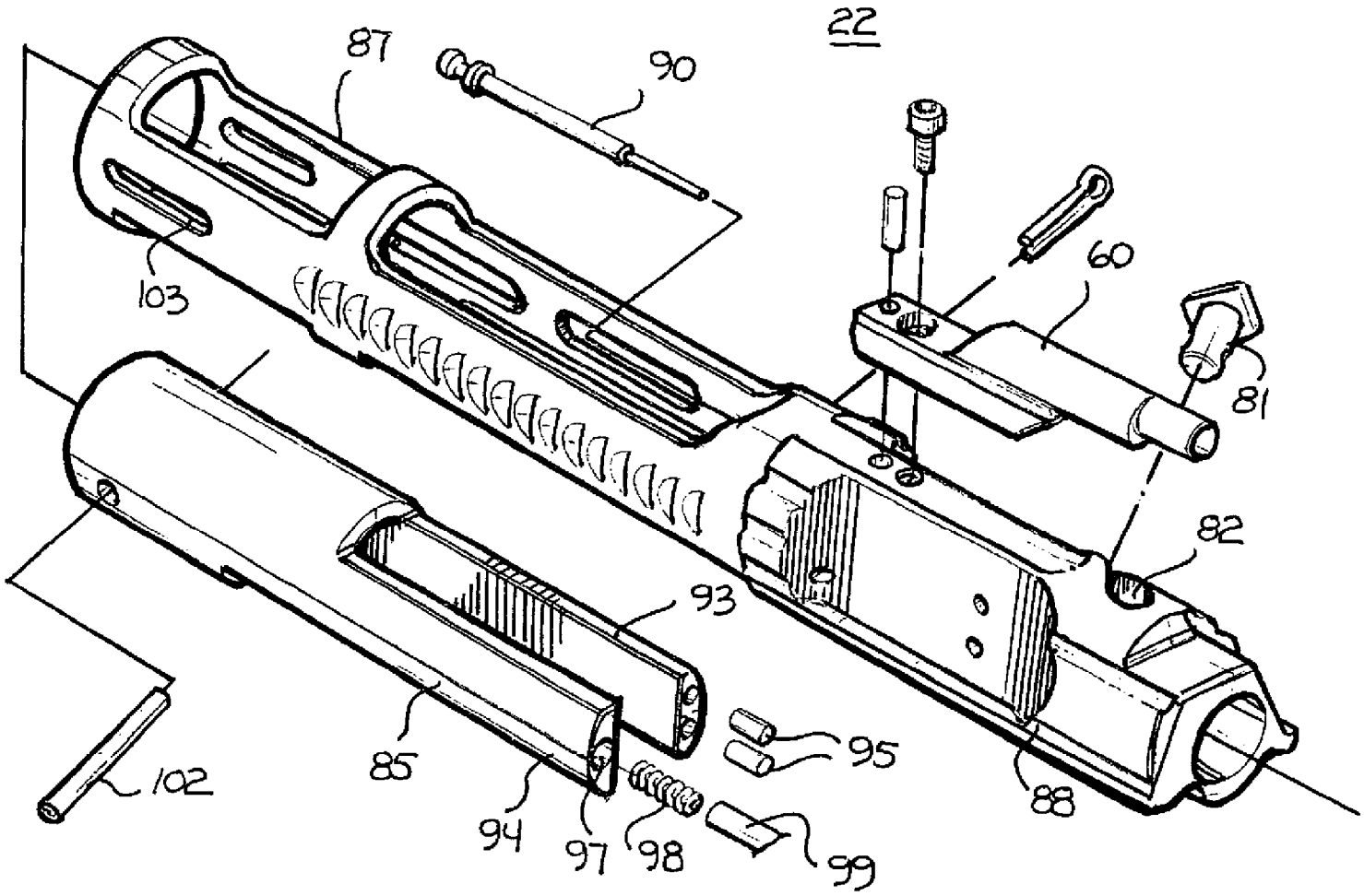
PRIOR ART Fig. 11
FIG. 11 is an exploded perspective view of a prior art bolt carrier and weight.

FIG. 11 is shown a prior art bolt carrier with a reciprocating mass that utilizes locating and alignment slots similar to the current invention. However, the prior art as seen in FIG. 11 is provided to slow down firing cycle and does not deal with elongated upper and lower receivers at all.

Figure 12:
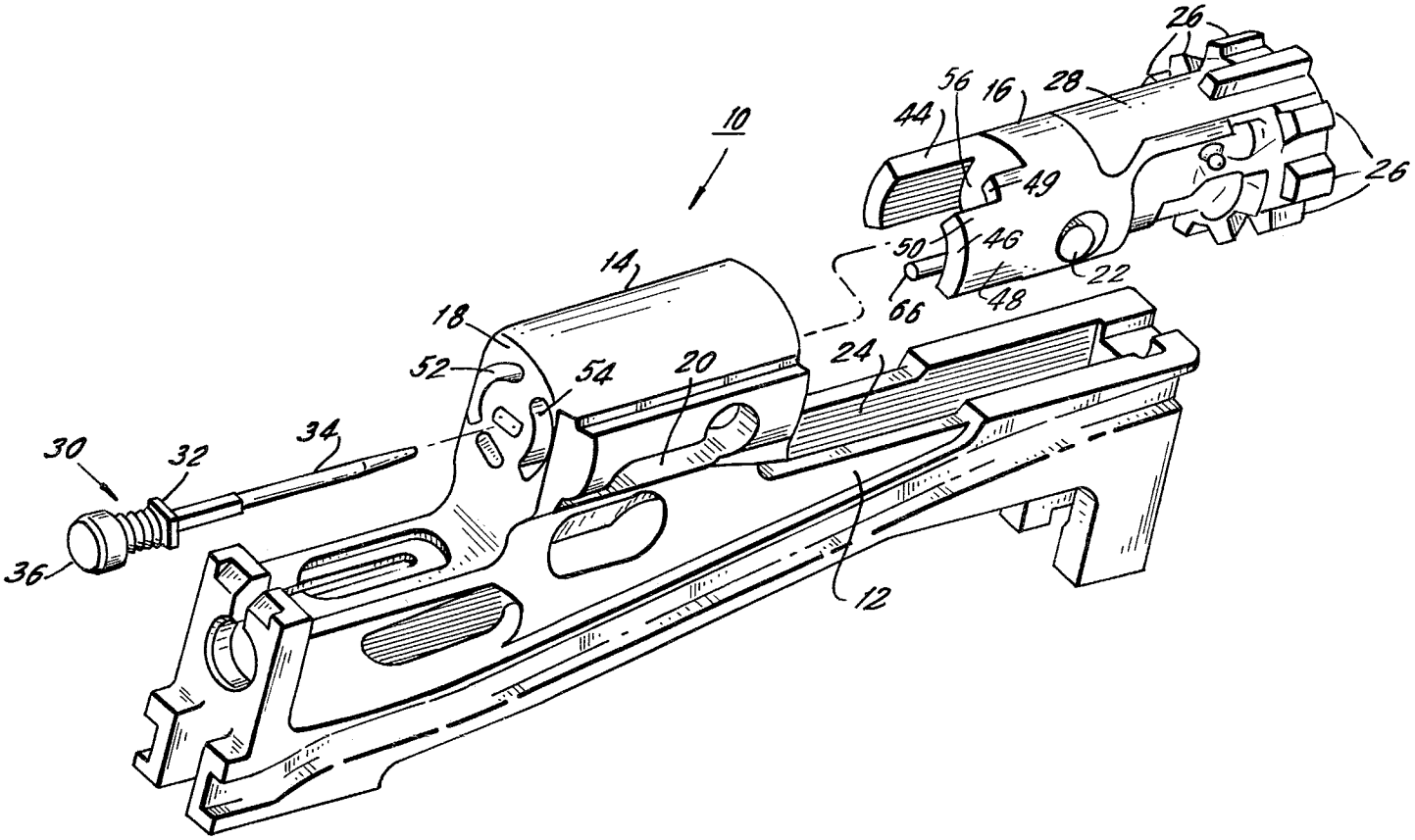
PRIOR ART Fig. 12
FIG. 12 is an exploded perspective view of a prior art buffered bolt assembly.

FIG. 12 is shown a prior art buffered bolt assembly which utilizes bolt extensions similar to the current invention but located on the front end of the bolt assembly rather than on the aft end as shown in the current invention. The buffered bolt assembly shown in prior art FIG. 12 seeks to transfer stress concentrations away from certain latches and cam pins. The current invention, although utilizing extension pieces, does not seek to transfer loads away from any cam pins or latches, but rather to extend the bolt carrier for use of long-action or other center fire cartridges.

I claim:

1. A bolt carrier system for a firearm, comprising:
a bolt carrier comprising a first stop surface; and
a bolt carrier extension movably coupled with the bolt carrier and comprising a second stop surface,
wherein the bolt carrier and the bolt carrier extension are arrangeable between an extended arrangement with the second stop surface spaced from the first stop surface and the bolt carrier and the bolt carrier extension defining a first total length, and a retracted arrangement with the stop surface and the second stop surface engaged with each other and the bolt carrier and the bolt carrier extension defining a second total length that is less than the first total length, and
wherein the bolt carrier and the bolt carrier extension are resiliently biased into the extended arrangement.

2. The bolt carrier system of claim 1, wherein the bolt carrier extension is slidably received by the bolt carrier.

3. The bolt carrier system of claim 1, wherein at least a portion of the bolt carrier extension is slidably received within a channel of the bolt carrier.

4. The bolt carrier system of claim 1, wherein the bolt carrier and the bolt carrier extension are resiliently biased into the extended arrangement via at least one spring.

5. The bolt carrier system of claim 4, wherein the at least one spring is positioned between at least a portion of the bolt carrier and at least a portion of the bolt carrier extension.

6. The bolt carrier system of claim 4, wherein the at least one spring comprises a first end portion engaged with an aft portion of the bolt carrier and a second end portion engaged with a forward portion of the bolt carrier extension.

7. The bolt carrier system of claim 4, wherein the at least one spring is pre-loaded in tension.

8. The bolt carrier system of claim 1, wherein the bolt carrier comprises an assembly that includes a component that defines the first stop surface.

9. The bolt carrier system of claim 1, wherein the first stop surface comprises a first aft end surface of the bolt carrier.

10. The bolt carrier system of claim 1, wherein the first stop surface and the second stop surface face each other.

11. The bolt carrier system of claim 1, wherein the second stop surface is defined by a flange of the bolt carrier extension.

12. The bolt carrier system of claim 11, wherein the flange of the bolt carrier extension is positioned at an aft end portion of the bolt carrier extension.

13. The bolt carrier system of claim 1, wherein the bolt carrier extension is integral.

14. The bolt carrier system of claim 1, wherein an aft portion of the bolt carrier includes a first outermost surface in a radial direction, and wherein the second stop surface of the bolt carrier extension does not extend radially past the first outermost surface of the bolt carrier.

15. A firearm, comprising:

a bolt carrier device, comprising:

a bolt carrier comprising a first stop surface; and a bolt carrier extension movably coupled with the bolt carrier and comprising a second stop surface, wherein the bolt carrier and the bolt carrier extension are arrangeable between an extended arrangement with the second stop surface spaced from the first stop surface and the bolt carrier and the bolt carrier extension defining a first total length, and a retracted arrangement with the stop surface and the second stop surface engaged with each other and the bolt carrier and the bolt carrier extension defining a second total length that is less than the first total length, and wherein the bolt carrier and the bolt carrier extension are resiliently biased into the extended arrangement.

16. The firearm of claim 15, wherein the bolt carrier extension is positioned in the extended arrangement prior to firing of the firearm, and wherein an aft end of the bolt carrier extension is positioned adjacent a buffer assembly of the firearm.

17. The firearm of claim 15, wherein the bolt carrier extension is slidably received by the bolt carrier.

18. The firearm of claim 15, wherein the bolt carrier and the bolt carrier extension are resiliently biased into the extended arrangement via at least one spring.

19. The firearm of claim 15, wherein the bolt carrier comprises an assembly that includes a component that defines the first stop surface.

20. The firearm of claim 15, wherein the first stop surface comprises a first aft end surface of the bolt carrier.

* * * * *